US007334862B2

(12) United States Patent
Kachi

(10) Patent No.: US 7,334,862 B2
(45) Date of Patent: Feb. 26, 2008

(54) IMAGE FORMING APPARATUS FOR PERFORMING RESTORATION PROCESS

(75) Inventor: Yasuhiko Kachi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 391 days.

(21) Appl. No.: 11/017,716

(22) Filed: Dec. 22, 2004

(65) Prior Publication Data

US 2005/0162452 A1 Jul. 28, 2005

(30) Foreign Application Priority Data

Dec. 25, 2003 (JP) ..... 2003-430547

(51) Int. Cl.
*B41J 2/165* (2006.01)

(52) U.S. Cl. ..... 347/22; 347/32; 347/33; 347/36; 347/29

(58) Field of Classification Search ..... 347/9, 347/13, 14, 20, 22–23, 29–34, 36, 42, 1; 400/701, 702, 702.1
See application file for complete search history.

(56) References Cited

U.S. PATENT DOCUMENTS

| | | | | |
|---|---|---|---|---|
| 5,040,000 | A | 8/1991 | Yokoi | 347/30 |
| 5,051,761 | A * | 9/1991 | Fisher et al. | 347/30 |
| 5,717,446 | A * | 2/1998 | Teumer et al. | 347/35 |
| 6,672,705 | B2 * | 1/2004 | Kitahara et al. | 347/30 |

FOREIGN PATENT DOCUMENTS

| | | | |
|---|---|---|---|
| JP | 2-48958 | A | 2/1990 |
| JP | 3-92358 | A | 4/1991 |
| JP | 4-197766 | A | 7/1992 |
| JP | 8-216400 | A | 8/1996 |
| JP | 10-175292 | A | 6/1998 |
| JP | 2001-113690 | A | 4/2001 |
| JP | 2001-287377 | A | 10/2001 |
| JP | 2003-341106 | A | 12/2003 |

* cited by examiner

*Primary Examiner*—Juanita D. Stephens
(74) *Attorney, Agent, or Firm*—Birch, Stewart, Kolasch & Birch, LLP

(57) ABSTRACT

The image forming apparatus comprises: a line type recording head in which a plurality of nozzles ejecting ink are arranged through a length corresponding to a full width of a recording medium; a recording medium conveyance device which supports and conveys the recording medium in a direction of conveyance of the recording medium and causes the recording head and the recording medium to move relatively to each other, the recording medium conveyance device including a medium supporting part which supports the recording medium, a plurality of opening sections being formed in the medium supporting part, the plurality of opening sections being arranged in a staggered matrix in such a manner that at least one of the plurality of opening sections is present throughout a whole width of a nozzle region of the recording head when the plurality of opening sections are projected so as to be aligned in a direction substantially orthogonal to the direction of conveyance of the recording medium; an ejection control device which performs control of preliminary ejection of the ink from the recording head toward the opening sections in synchronism with positions of the opening sections; and an ink receiving member which receives the ink in the preliminarily ejection through the opening sections.

23 Claims, 8 Drawing Sheets

IMAGE FORMING APPARATUS FOR PERFORMING RESTORATION PROCESS

BACKGROUND OF THE INVENTION

1. Field of the Invention

The present invention relates to an image forming apparatus, and more particularly, to an image forming apparatus comprising a device which restores nozzles of a recording head.

2. Description of the Related Art

An image forming apparatus such as an inkjet printer has a recording head comprising a plurality of nozzles and forms an image on recording paper by ejecting ink onto the recording paper from nozzles of the recording head. A portion of the plurality of nozzles may generate ejection errors, such as ink blockages, or defects in the amount of ink ejected (the dot size deposited on the recording paper) or the direction of flight of the ink (the position at which the ink is deposited), due to drying of the ink, adherence of foreign material, or the like. Nozzles suffering from ejection errors of this kind cause a decline in the quality of the recorded image, and therefore processing for restoring the recording head is carried out as necessary.

Japanese Patent Application Publication No. 2001-287377 discloses that restoration processing is carried out by means of a restoring device for performing flushing of the nozzles of the recording head (preliminary ejection of ink from the nozzles), wiping of the nozzles, and nozzle suction (suction of defective ink from the nozzles). The restoring device is moved relatively to the recording head, in close proximity to same, by means of an opening section formed in the conveyance belt that transports the recording paper. However, in a line type recording head in which nozzles are arrayed throughout a length corresponding to the full width of the recording paper, it is necessary to make the dimension of the opening of the opening section equal to or greater than the size of the recording paper. Therefore, a problem arises in that the rigidity of the conveyance belt is reduced by the presence of a large opening section. A further problem arises in that preliminary ejection can only be carried out in the specific open region of the belt, and hence productivity declines.

Japanese Patent Application Publication No. 2001-113690 discloses that opening sections for the purpose of maintenance of a plurality of nozzles are arranged at predetermined intervals on a conveyance belt, in the direction of conveyance of the recording paper, and preliminary ejection is performed for discharging ink toward these opening sections. However, a problem arises in that it is not possible to carry out wiping or nozzle suctioning. Moreover, since the recording paper is conveyed by simply being placed on a conveyance belt, a further problem arises in that the recording paper cannot be conveyed stably.

SUMMARY OF THE INVENTION

The present invention has been contrived in view of such circumstances, and an object thereof is to arrange an image forming apparatus in which restoration processes, such as nozzle flushing (preliminary ejection), wiping, nozzle suctioning, or the like, and nozzle drying prevention processes, such as capping, can be performed while maintaining the rigidity of a medium supporting section (conveyance belt), and while also contributing toward space savings by compactification of the apparatus.

In order to attain the aforementioned object, the present invention is directed to an image forming apparatus, comprising: a line type recording head in which a plurality of nozzles ejecting ink are arranged through a length corresponding to a full width of a recording medium; a recording medium conveyance device which supports and conveys the recording medium in a direction of conveyance of the recording medium and causes the recording head and the recording medium to move relatively to each other, the recording medium conveyance device including a medium supporting part which supports the recording medium, a plurality of opening sections being formed in the medium supporting part, the plurality of opening sections being arranged in a staggered matrix in such a manner that at least one of the plurality of opening sections is present throughout a whole width of a nozzle region of the recording head when the plurality of opening sections are projected so as to be aligned in a direction substantially orthogonal to the direction of conveyance of the recording medium; an ejection control device which performs control of preliminary ejection of the ink from the recording head toward the opening sections in synchronism with positions of the opening sections; and an ink receiving member which receives the ink in the preliminarily ejection through the opening sections.

According to the present invention, since the opening sections are arranged in the staggered matrix in such a manner that the opening sections are present throughout the full width of the nozzle region of the recording head, then restoration processing by means of preliminary ejection can be carried out for all nozzles. Furthermore, since the surface area of each opening section can be reduced by adopting the staggered matrix arrangement for the opening sections, then it is possible to prevent decline in the rigidity of the medium supporting part. Furthermore, since preliminary ejection can be performed in synchronism with the positions of the opening sections, then if a composition is adopted where preliminary ejection is performed while conveying the recording medium, it is possible to carry out restoration processing without interrupting image formation. In this case, it is preferable that a recording medium determining device which determines the conveyance of the recording medium is arranged on the upstream side from the recording medium conveyance device, and a phase determining device which determines the positions of the opening sections is also arranged. If the positions of the recording medium under conveyance and the opening sections are determined respectively by the recording medium determining device and the phase determining device, then preliminary ejection can be performed while conveying the recording medium. Furthermore, if an ink receiving member is arranged inside the recording medium conveyance device, then the space for installing equipment for restoration processing can be reduced, the image forming apparatus can be made more compact, and hence the space required to install the apparatus can be reduced. According to the present invention, since it is not necessary to form ink receptacles or the like for the purpose of preliminary ejection in the medium supporting part, then special surface treatment, such as liquid repelling treatment, is not required for the medium supporting part. Here, ink that is received by the ink receiving member includes both ink that can be reused and ink that is discarded.

Preferably, the image forming apparatus further comprises: a phase determining device which performs determination of the positions of the opening sections, wherein the ejection control device performs the control according to a result of the determination obtained by the phase determining device. According to this, preliminary ejection of ink can be carried out reliably, by determining the position of the opening sections.

The present invention is also directed to an image forming apparatus, comprising: a line type recording head in which a plurality of nozzles ejecting ink are arranged through a length corresponding to a full width of a recording medium; a recording medium conveyance device which supports and conveys the recording medium in a direction of conveyance of the recording medium and causes the recording head and the recording medium to move relatively to each other, the recording medium conveyance device including a medium supporting part which supports the recording medium, a plurality of opening sections being formed in the medium supporting part, the plurality of opening sections being arranged in a staggered matrix in such a manner that at least one of the plurality of opening sections is present throughout a whole width of a nozzle region of the recording head when the plurality of opening sections are projected so as to be aligned in a direction substantially orthogonal to the direction of conveyance of the recording medium; a wiping member which wipes a nozzle face of the recording head through the opening sections; a wiping member advancing and retracting device which causes the wiping member to advance and retract with respect to the nozzle face through the opening sections; a wiping member sliding device which causes the wiping member to slide with respect to the nozzle face; and a wipe control device which performs control of a wiping action of the wiping member in synchronism with positions of the opening sections.

According to the present invention, since the opening sections are arranged in the staggered matrix in such a manner that opening sections are present throughout the full width of the nozzle region of the recording head, then restoration processing by means of wiping members can be carried out for all nozzles in the recording head. Furthermore, since the surface area of each opening section can be reduced by adopting the staggered matrix arrangement for the opening sections, then it is possible to prevent decline in the rigidity of the medium supporting part. Moreover, if a plurality of wiping members are arranged, each having a size that corresponds to the opening sections, it is then possible to wipe the whole nozzle surface uniformly in comparison to a case where the whole nozzle surface is wiped by means of a single wiping member. Furthermore, since wiping can be performed in synchronism with the position of the opening sections, then if a composition is adopted where wiping is performed while conveying the recording medium, it is possible to carry out restoration processing without interrupting image formation. In this case, it is preferable that a recording medium determining device which determines the conveyance of the recording medium is arranged on the upstream side from the recording medium conveyance device, and a phase determining device which determines the position of the opening sections is also arranged. If the positions of the recording medium under conveyance and the opening sections are determined respectively by the recording medium determining device and the phase determining device, then wiping can be performed while conveying the recording medium. Furthermore, if the wiping members are arranged inside the recording medium conveyance device, then the space for installing equipment for restoration processing can be required, and hence the image forming apparatus can be made more compact in size. The wiping operation includes the advancing and retracting operations and the sliding operation of the wiping members. As a concrete mode of a wiping member advancing and retracting device for the wiping members, in a case where the present invention is applied to an image forming apparatus in which the recording medium is disposed horizontally during image formation, for example, then desirably, a raising and lowering device is used in order to raise and lower the wiping member, thus causing it to advance toward and retract from the nozzle face. Moreover, examples of a wiping member sliding device include: (a) a device that causes an individual wiping member or the wiping members arranged at respective opening sections to slide along the nozzle face; (b) a device that drives the wiping members arranged at respective opening sections together so as to slide along the nozzle face; (c) a device in which the wiping members are installed on the recording medium conveyance device and the wiping members are caused to slide along the nozzle face by driving the recording medium conveyance device, and the like.

Preferably, the image forming apparatus further comprises: a phase determining device which performs determination of the positions of the opening sections, wherein the wipe control device performs the control according to a result of the determination obtained by the phase determining device. According to this, the wiping operation can be carried out reliably by determining the position of the opening sections.

The present invention is also directed to an image forming apparatus, comprising: a line type recording head in which a plurality of nozzles ejecting ink are arranged through a length corresponding to a full width of a recording medium; a recording medium conveyance device which supports and conveys the recording medium in a direction of conveyance of the recording medium and causes the recording head and the recording medium to move relatively to each other, the recording medium conveyance device including a medium supporting part which supports the recording medium, a plurality of opening sections being formed in the medium supporting part, the plurality of opening sections being arranged in a staggered matrix in such a manner that at least one of the plurality of opening sections is present throughout a whole width of a nozzle region of the recording head when the plurality of opening sections are projected so as to be aligned in a direction substantially orthogonal to the direction of conveyance of the recording medium; a capping member which covers the nozzles by making contact with a nozzle face of the recording head through the opening sections; a capping member advancing and retracting device which causes the capping member to advance and retract with respect to the nozzle face through the opening sections; and a capping control device which performs control of the opening sections to halt in positions facing the capping member, and control of the capping member advancing and retracting device to advance and retract the capping member with respect to the nozzle face through the opening sections.

According to the present invention, since the opening sections are arranged in the staggered matrix in such a manner that opening sections are present throughout the full width of the nozzle region of the recording head, then capping can be carried out for all nozzles. Furthermore, since the surface area of each opening section can be reduced by adopting the staggered matrix arrangement for the opening sections, then it is possible to prevent decline in the rigidity of the medium supporting part. Furthermore, if the capping members are arranged inside the recording medium conveyance device, then the space for installing equipment for restoration processing can be reduced, and hence the image forming apparatus can be made more compact in size. Moreover, since the capping members are split into the form of the staggered matrix, then the sealing characteristics between the nozzles and the capping members can be improved in comparison with a case where the whole nozzle face is capped by means of a single capping member.

Preferably, the image forming apparatus further comprises: a phase determining device which performs determination of the positions of the opening sections, wherein the capping control device performs the control according to a result of the determination obtained by the phase determining device. According to this, the capping members can be advanced or retracted reliably, by determining the position of the opening sections.

Preferably, at least two of the plurality of opening sections are formed along the direction of conveyance of the recording medium in the medium supporting part. According to this, the gap between consecutively conveyed recording media, in other words, the gap between sheets of recording media, can be used to perform restoration processing for the recording head, without interrupting image formation. Hence, the productivity of image formation can be improved. Moreover, it is not necessary to register the position at which the recording medium is placed on the medium supporting part, as in the prior art, and hence image formation can be performed without limiting the position at which the recording medium is placed.

Preferably, the image forming apparatus further comprises a negative pressure generating device to create negative pressure by which the medium supporting part holds the recording medium. According to this, in the case of a composition where the recording medium is held onto the vacuum suction belt by suction through suction holes formed in the vacuum suction belt, by means of the suction chamber, for example, it is possible to convey the recording medium reliably. Moreover, if the aforementioned ink receiving members, wiping members, suction caps, and the like, are arranged inside the suction chamber, then it is possible to reduce the space required for installing equipment for restoration processing, and hence the image forming apparatus can be made more compact in size. In particular, if the opening sections are also used as the suction holes, then since the ink ejected by a preliminary ejection from the recording head can be suctioned by generating an air flow in the vicinity of the opening sections, it is possible to recover ink smoothly and dispersion of ink to the exterior of the image forming apparatus can be prevented.

Alternatively, the medium supporting part may hold the recording medium on a surface thereof by means of static electricity. According to this, the recording medium can be conveyed stably, without using a suction chamber.

The medium supporting part may include a drum which rotates while supporting the recording medium. According to this, the recording medium can be conveyed stably, without using a belt.

Preferably, the image forming apparatus further comprises an ink receiving member movement device which moves the ink receiving member between a standby position and a position facing a nozzle face of the recording head.

Preferably, the image forming apparatus further comprises one of: an ink receiving member movement device which moves the ink receiving member between a standby position and a position facing a nozzle face of the recording head; a wiping member movement device which moves the wiping member between a standby position and a position facing the nozzle face of the recording head; and a capping member movement device which moves the capping member between a standby position and a position facing the nozzle face of the recording head. According to this, since the ink receiving member, the wiping member or the capping member used for restoration processing is moved between the standby position and a position facing the nozzle surface of the recording head, it is possible to retract these members from the opening sections. Therefore, in the case of the image forming apparatus in which the recording medium is held onto the vacuum suction belt, for example, the opening space of the opening sections can be increased by retracting the ink receiving member, the wiping member or the capping member from the opening sections during image formation. Hence, the suction force for the recording medium can be increased. In a further mode of the present invention, by combining this composition with the composition where at least two of the opening sections are formed in the medium supporting part in the direction of conveyance of the recording medium, the productivity of image formation can be increased without restricting the position at which the recording medium is held.

Preferably, the image forming apparatus further comprises a suction device which is connected to the capping member to suck the ink from the nozzles. According to this, it is not necessary to arrange further suction caps. Here, by abutting the capping member against the nozzle surface of the recording head while the image forming apparatus is switched off or is at standby, it is also possible to use the capping members as caps for preventing drying of the nozzles. During a process for preventing drying of the nozzles in this way, the operation of the suctioning device (by a suctioning pump, or the like) is halted.

A "full line type recording head" is usually disposed following a direction that is orthogonal to the relative direction of conveyance of the recording medium (a medium conveyance direction), but modes may also be adopted wherein the recording head is disposed following an oblique direction that forms a predetermined angle with respect to the direction orthogonal to the direction of conveyance of the recording medium. Furthermore, the arrangement of the nozzles in the recording head is not limited to being a single line type arrangement, and a matrix arrangement comprising a plurality of rows may also be adopted. Moreover, a mode may also be adopted wherein a row of nozzles corresponding to the entire width of the recording medium is constituted by combining a plurality of short dimension recording head units having nozzle rows which do not reach a length corresponding to the entire width of the recording medium.

Furthermore, in the present specification, the term "recording" indicates a broad concept including the formation of text and images. "Recording medium" indicates a medium on which an image is formed by means of a recording head (this medium may be called an image forming medium, recording medium, image receiving medium, recording paper, or the like), and this term includes various types of media, irrespective of material and size, such as continuous paper, cut paper, sealed paper, resin sheets, such as OHP sheets, film, cloth, and the like.

If a state where ink is not ejected from the nozzles of the recording head continues for a certain time or more, then the solvent in the ink in the vicinity of the nozzles of the recording head evaporates, the viscosity of the ink in the vicinity of the nozzles increases, and it becomes impossible to eject ink from the nozzles, even if the actuators for discharging ink are operated. In the present specification, "preliminary ejection" (also referred to as "dummy ejection", "purge", liquid ejection", and so on) means an operation in which, before reaching such a state the actuator is operated in a viscosity range that allows ejection by the operation of the actuator, and the ink of which viscosity has increased inside the nozzles is ejected toward the ink receptacles. After soiling on the nozzle surface of the recording head has been cleaned by means of a wiping member, such as a blade, preliminary ejection is carried out in order to prevent foreign material from being introduced into the nozzles by the blade.

Furthermore, if the increase in the viscosity of the ink inside the nozzles exceeds a certain level, then it becomes impossible to eject the ink by means of a preliminary ejection, and hence a suction operation is carried out as described below.

More specifically, when the viscosity of the ink inside the nozzles has increased to or above a certain level, it becomes impossible to eject ink from the nozzles, even if the actuators are operated. Furthermore, if air bubbles become mixed into the ink inside the nozzles or the pressure chambers, then it becomes impossible to eject the ink from the nozzles, even if the actuators are operated. In cases of this kind, a suctioning device abuts against the nozzle surface of the print head and the ink inside the pressure chambers is suctioned out by a pump, or the like, thereby removing the ink containing air bubbles or the ink of increased viscosity.

The aforementioned suction operation is carried out with respect to all of the ink inside the pressure chambers, and therefore it consumes a large amount of ink. Consequently, it is desirable that a preliminary ejection is carried out, whenever possible, when the increase in viscosity is still small.

According to the present invention, restoration processes, such as nozzle flushing (preliminary ejection), wiping, nozzle suctioning, or the like, and nozzle drying prevention processes, such as capping, can be performed while maintaining the rigidity of a medium supporting section (conveyance belt), and while also contributing toward space savings by compactification of the apparatus.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Below, a first embodiment of an image forming apparatus according to the present invention is described with reference to the accompanying drawings.

Figure 1:
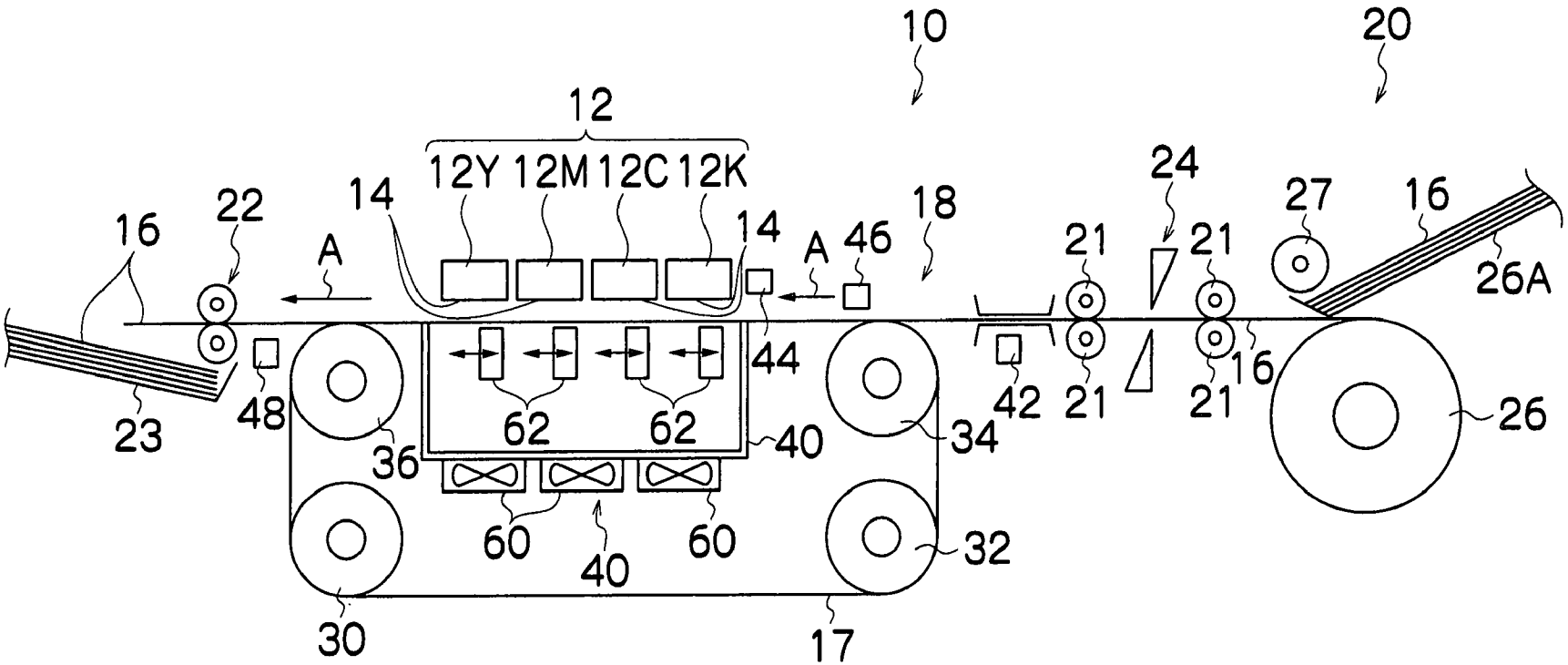
FIG. 1 is a side view showing an image forming apparatus according to an embodiment of the present invention.

FIG. 1 is a diagram of the general composition of an inkjet type image forming apparatus according to an embodiment of the present invention. This image forming apparatus 10 comprises: recording heads 12K, 12C, 12M, 12Y for ink colors of black (K), cyan (C), magenta (M) and yellow (Y) (referred to simply as "recording head 12" in some instances below); a belt conveyance unit 18, which is disposed facing the nozzle face 14 of the recording head 12, for conveying a recording paper 16 on a belt 17 while keeping the recording paper 16 flat; a paper supply unit 20 for supplying a recording paper 16; and a paper output unit 22 for outputting recording paper formed with an image to the exterior. Furthermore, a paper output tray 23, or the like, for stacking sheets of recording paper 16 formed with images is arranged in the paper output unit 22.

The recording head 12 is constituted by a so-called full line type head, wherein a line type head having a length corresponding to the width of the recording paper 16 is disposed in a fixed position, in a direction orthogonal to the paper conveyance direction. The recording heads 12K, 12C, 12M, 12Y corresponding to respective ink colors are disposed in the order, black (K), cyan (C), magenta (M) and yellow (Y), from the upstream side, following the direction of conveyance of the recording paper 16 (arrow A).

In this example, a composition including the four standard colors: black, cyan, magenta and yellow, is described, but the combination of ink colors and the number of colors are not limited to the present embodiment, and it is also possible to add light inks, dark inks, or special color inks, as necessary. For example, a composition which includes additional print heads for discharging light inks, such as light cyan and light magenta, may also be adopted. Furthermore, the sequence of alignment of the color heads is not limited in particular.

The nozzle face 14 is arranged on the lower portion of each recording head 12. A color image, or the like, is formed on the recording paper 16 by discharging inks of respective colors onto the recording paper 16 from the nozzles arranged on the nozzle faces 14, while conveying the recording paper 16.

Rolled paper (continuous paper) 26 is set in place detachably in the paper supply unit 20. A paper supply unit supplying the rolled paper 26 is used as one example, but it is also possible to adopt a composition where a plurality of rolled papers of different paper widths and paper qualities, or the like, are used in parallel with the rolled paper 26. Furthermore, it is also possible to supply paper by means of a cassette 26A containing cut paper loaded in layers, either in conjunction with or in lieu of the rolled paper 26. In this case, a supply roller 27 for conveying and supplying cut paper from the cassette 26A is arranged.

Pickup rollers 21 for picking up the recording paper 16 from the rolled paper 26 are arranged in the vicinity of the paper supply unit 20. The force of a motor 25 (shown in FIG. 7) is transmitted to at least one of the pick-up rollers 21, and the recording paper 16 picked up thereby is conveyed from right to left in FIG. 1. A shearing cutter 24 is disposed between the rollers 21, and the recording paper 16 picked up from the roller paper 26 is cut to a predetermined size by means of the cutter 24. A composition may also be adopted wherein a decurling unit (not shown) is disposed in the vicinity of the cutter 24 in order to remove curl from the recording paper 16 caused by its having been held in the rolled paper 26.

The belt conveyance unit 18 has a configuration where the endless belt 17 is set around rollers 30, 32, 34 and 36, in such a manner that at least the portion of the endless belt 17 facing the nozzle face 14 of the recording head 12 forms a horizontal plane (flat plane). The belt 17 is driven in the counterclockwise direction in FIG. 1 by the motive force of a motor 37 (shown in FIG. 7) being transmitted to at least one of the rollers 30, 32, 34, 36 around which the belt 17 is set, and the recording paper 16 held onto the belt 17 by suction is conveyed from right to left in FIG. 1.

A suction chamber 40 is disposed in a position facing the recording head 12 on the interior side of the belt 17, which is set around the rollers 30, 32, 34 and 36.

There are also arranged a recording paper determination unit 42 for reading out the position and size of the recording paper 16, a recording position determination unit 44 for determining the timing of ink ejection onto the recording paper 16, a phase determination unit 46 for determining the phase of the belt 17, and a recording paper trailing end detection unit 48 for detecting blockage of the recording paper 16 and determining the timing at which the next sheet is to be supplied.

Here, in a full-line head comprising rows of nozzles that have a length corresponding to the entire width of the paper (recording paper 16), the "main scanning" is defined as the driving of the nozzles to print one line (a line formed of a row of dots, or a line formed of a plurality of rows of dots) in the width direction of the recording paper (the direction perpendicular to the direction of conveyance of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction traced by one line (or the longitudinal direction of a band-shaped region) recorded by means of the aforementioned main scanning operation is called the main scanning direction, and the direction in which the aforementioned sub-scanning operation is performed is called the sub-scanning direction. In other words, in the present embodiment, the direction of conveyance of the recording paper 16 is the sub-scanning direction and the direction orthogonal to this direction is the main scanning direction.

Figure 2:
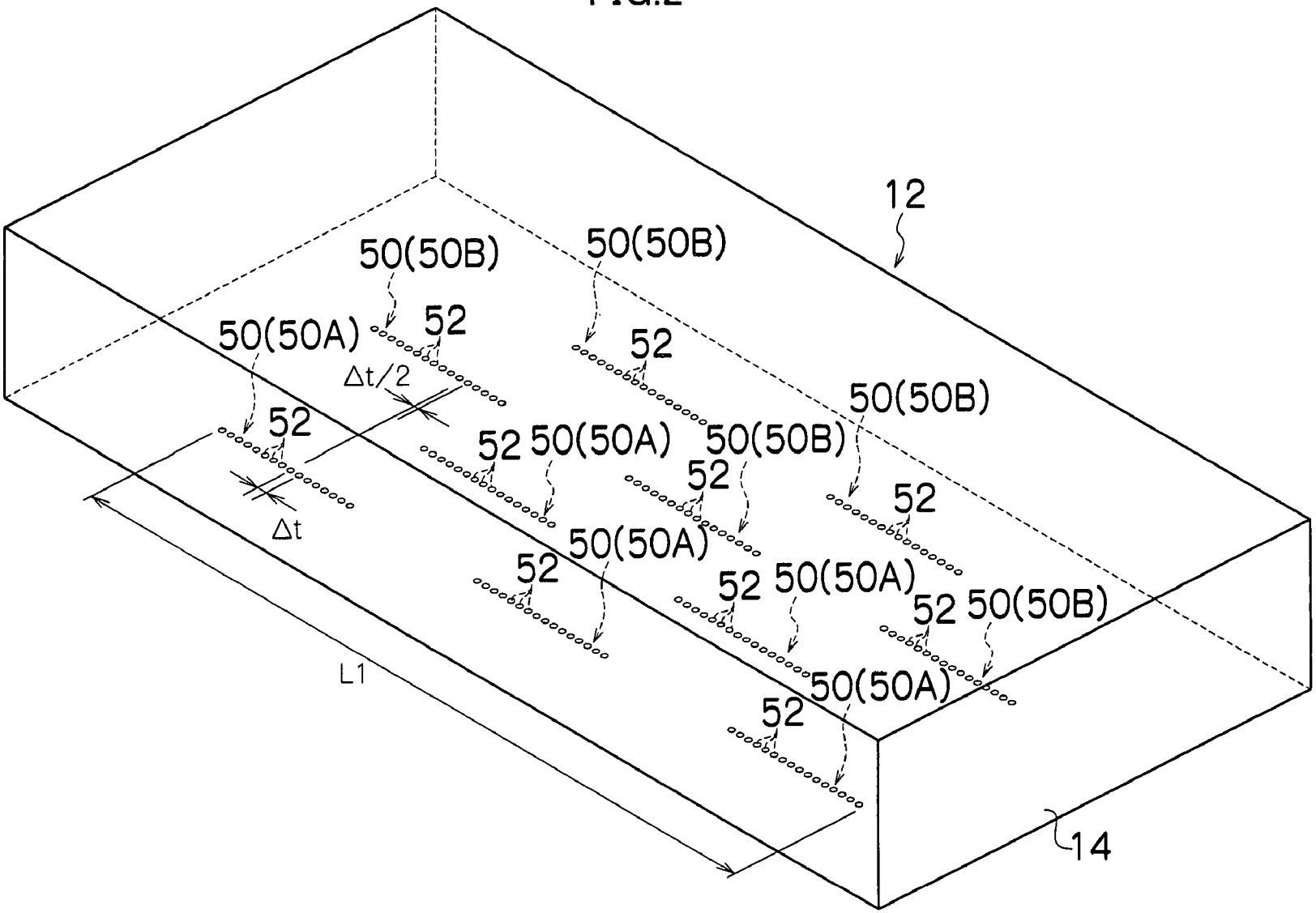
FIG. 2 is an oblique view showing a recording head used in the image forming apparatus.
Figure 3:
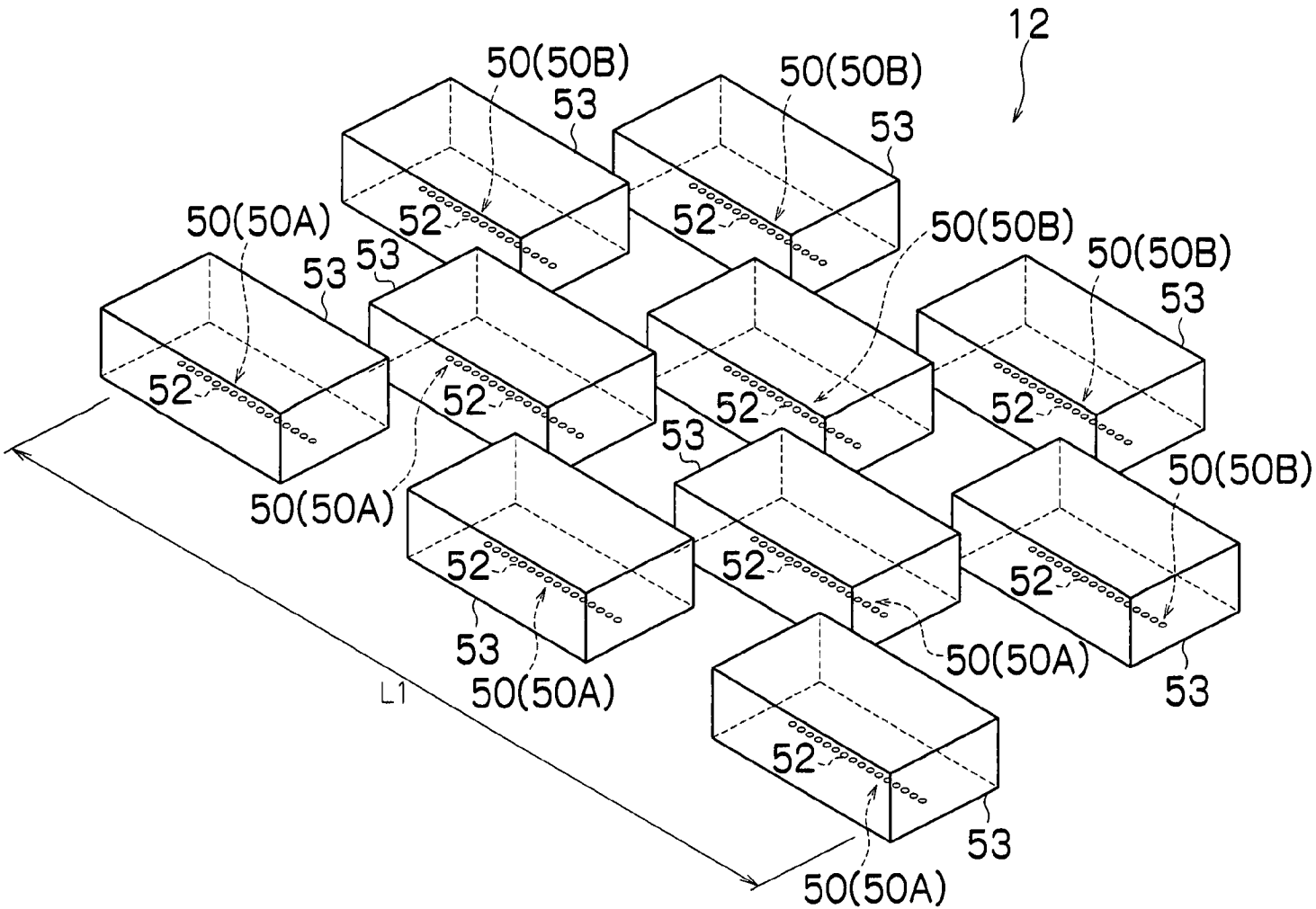
FIG. 3 is an oblique view showing another example of the recording head used in the image forming apparatus.

As shown in FIG. 2, a plurality of nozzle groups 50 (50A, 50B) are arranged in the form of a staggered matrix on the nozzle face 14 on the under side of the recording head 12. Each nozzle group 50 comprises of nozzles 52 arranged linearly at a uniform pitch ($\Delta t$) in the main scanning direction. Furthermore, the nozzle group 50A on the downstream side in the paper conveyance direction and the nozzle group 50B on the upstream side in the paper conveyance direction are mutually displaced by a half pitch ($\Delta t/2$) in the main scanning direction. The recording head 12 having this structure can be treated equivalently to a head in which nozzles 52 are arranged at a uniform pitch $\Delta t/2$ in a single linear fashion throughout the full width L1, and hence a high-density nozzle arrangement can be achieved. As a further mode of the recording head 12, it is also possible to adopt a composition as shown in FIG. 3, where a plurality of split type recording heads 53, each comprising a nozzle group 50 on the under side thereof, are arranged in the form of a staggered matrix. Each split type recording head 53 is supported by a supporting structure (not shown). By adopting a configuration of this kind, a line head of high density and high accuracy can be composed readily.

Figure 4A:
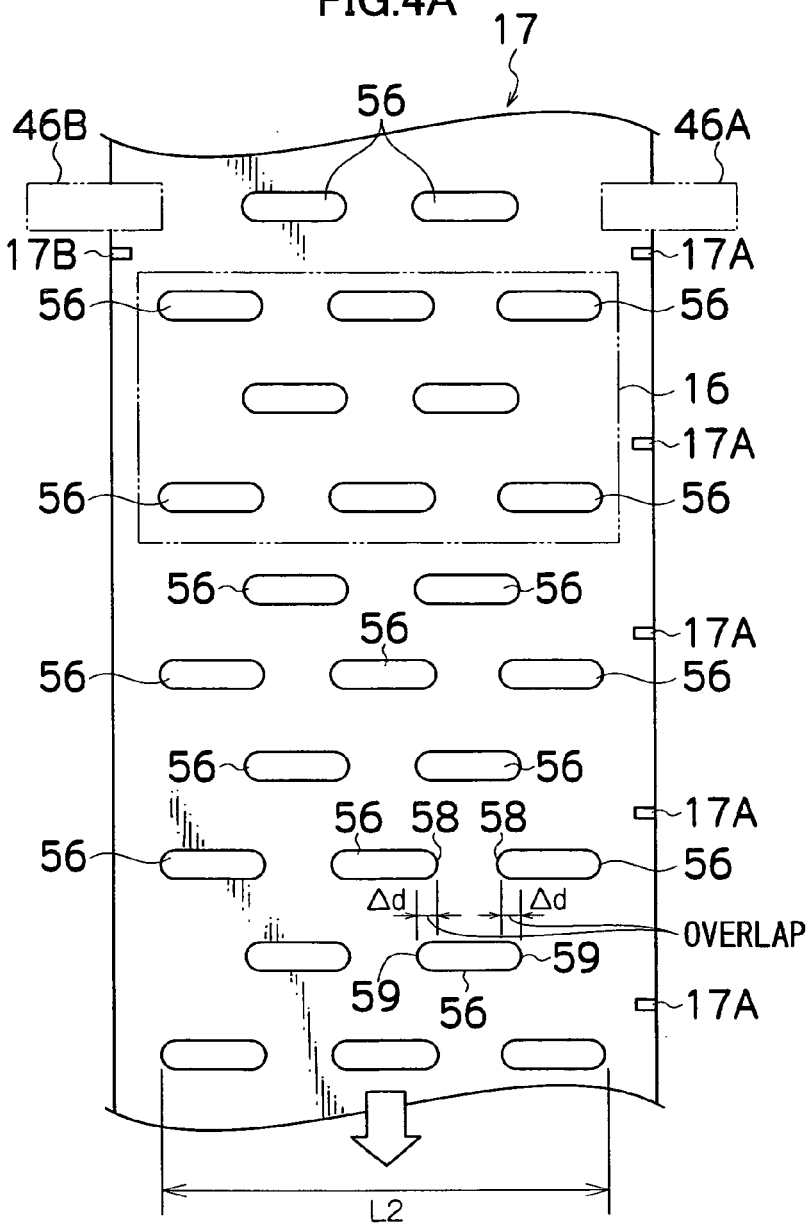
FIGS. 4A and 4B are plan views of a belt used in the image forming apparatus.
Figure 4B:
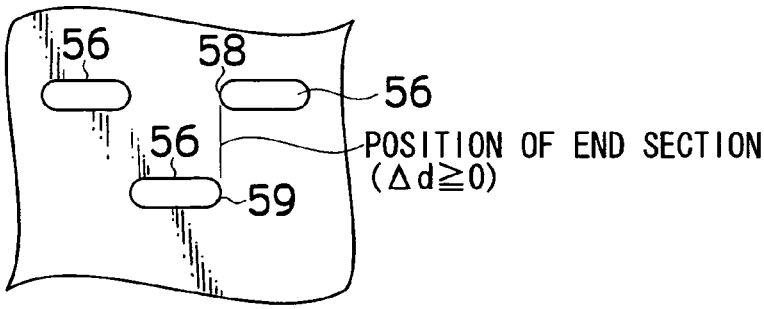

As shown in FIG. 4A, the belt 17 has a greater width than the width of the recording paper 16, and a plurality of suction holes 56 are formed in the form of a staggered matrix following the direction of conveyance of the recording paper 16, on the full surface of the belt 17. The suction holes 56 are disposed so as to face the position on the recording head 12 where the nozzle group 50 is positioned (see FIGS. 2 and 3), and the suction holes 56 are formed in such a manner that the respective end positions of the suction holes 56, and in particular, the end sections 58 of the suction holes 56 in the orthogonal direction to the paper conveyance direction, and the end sections 59 of the suction holes 56 adjacent to these in the orthogonal direction to the paper conveyance direction, overlap mutually by $\Delta d$ in the paper conveyance direction. Thus, if the suction holes 56 are projected so as to be aligned in a direction substantially orthogonal to the paper conveyance direction, then at least one suction hole 56 is present throughout the full width of the nozzle region (L1 in FIGS. 2 and 3) of the recording head 12. The effective width L2 of the suction holes 56 and the full width L1 of the nozzle region have a relationship $L2 \geqq L1$. In order that restoration processing is carried out for all of the nozzle groups 50 on the recording head 12, it is necessary that the overlap portion $\Delta d$ is set to $\Delta d \geqq 0$, as illustrated in FIG. 4B. Furthermore, the interval between the suction holes 56 in the paper conveyance direction is not limited in particular, but desirably, this interval is set in such a manner that the suction holes 56 are arranged in a uniform pattern following the direction of conveyance of the recording paper 16. In particular, desirably, the suction holes 56 are formed at predetermined intervals over the whole face of the belt 17 as shown in FIG. 4A, in such a manner that when restoration processing for the recording head is carried out, as described below, one of the suctions holes 56 is positioned between the trailing end of one recording paper 16 being conveyed and the leading end of the next recording paper 16 to be conveyed.

As shown in FIG. 4A, phase determination units 46A and 46B constituting the phase determination unit 46 are disposed so as to face the side edges of the belt 17, and the phase determination unit 46 determines the position of the suction holes 56 by detecting marks 17A and 17B for determining the phase of the belt which are formed on the side edges of the belt 17. The procedure for determining the position of the suction holes 56 by means of the phase determination unit 46 is described hereafter.

Figure 5:
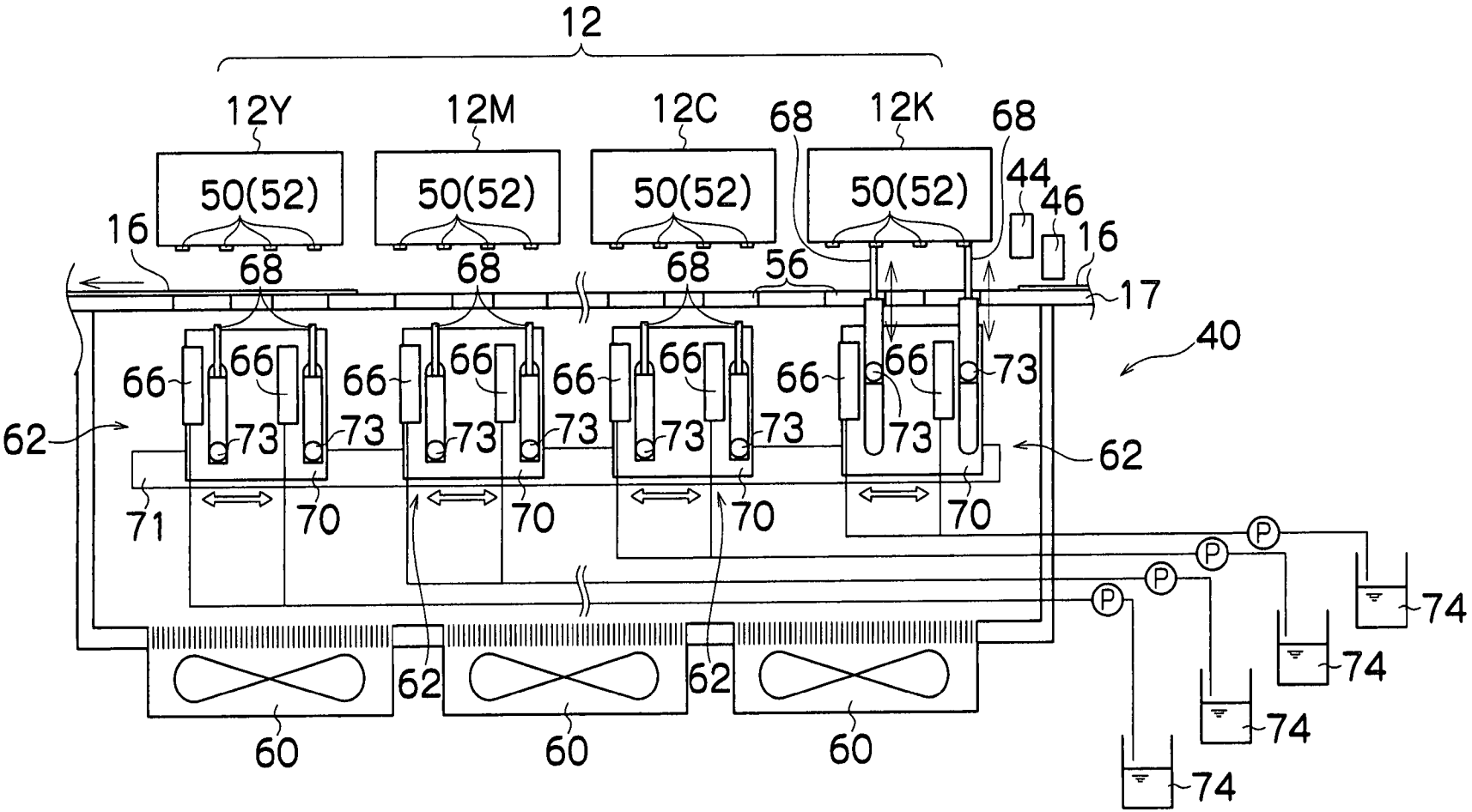
FIG. 5 is a cross-sectional view showing the detailed structure of a nozzle restoring device used in the image forming apparatus.

As shown in FIG. 5, fans 60, nozzle restoring devices 62, and the like, are arranged in the suction chamber 40. The fans 60 are installed on the floor of the suction chamber 40 and the air inside the suction chamber 40 is expelled to the exterior of the suction chamber 40 by means of the fans 60.

The nozzle restoring devices 62 comprise: ink receptacles 66 and wiping blades 68 disposed so as to face the recording head 12; raising and lowering devices 70, which move the ink receptacles 66 and the wiping blades 68 so as to advance toward and retract from the recording heads 12; and a movement device 71 for causing the respective raising and lowering devices 70 to move independently following the direction of conveyance of the recording paper 16.

Figure 6:
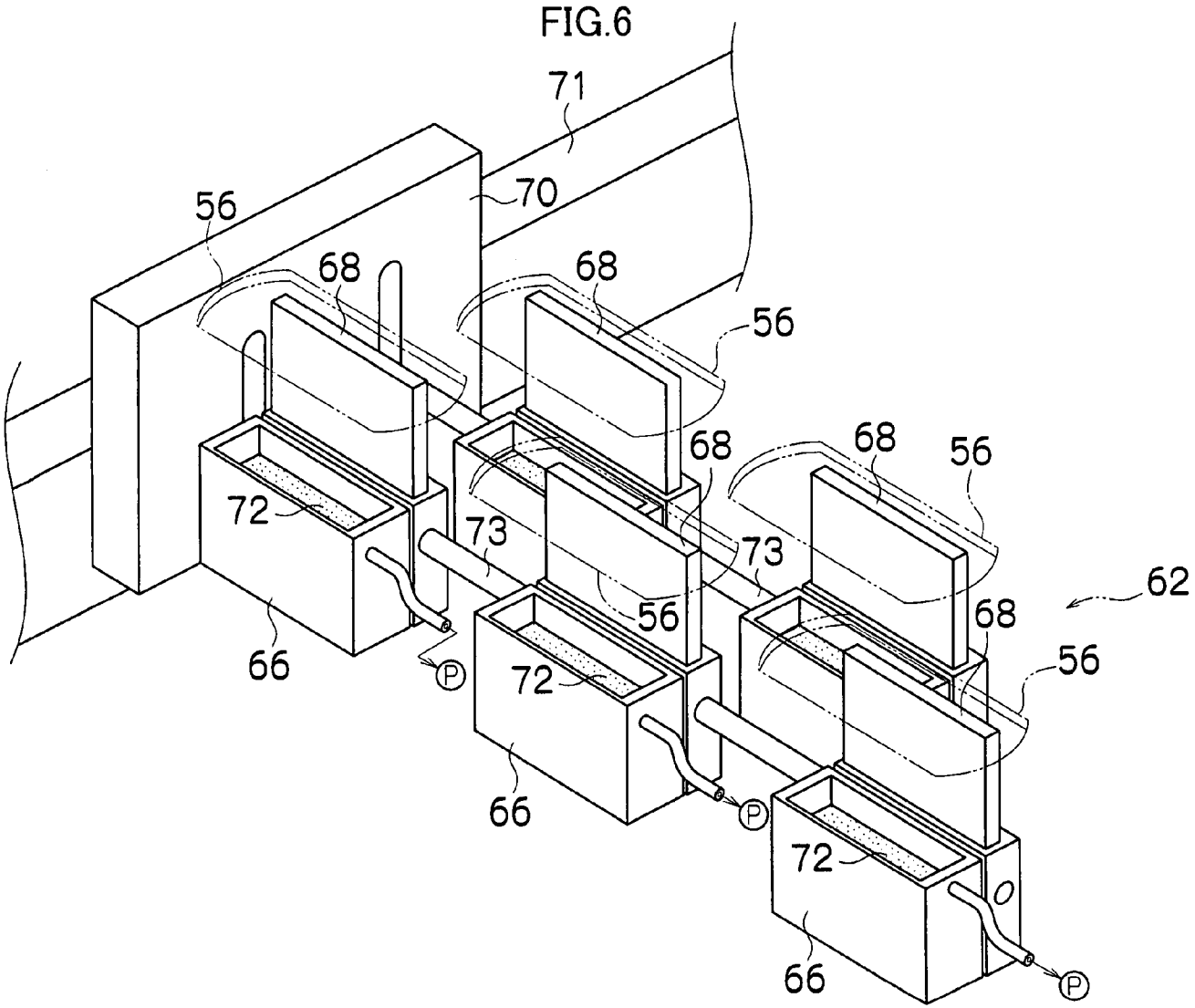
FIG. 6 is an oblique view showing the detailed structure of the nozzle restoring device.

As shown in FIG. 6, the upper edge of each ink receptacle 66 is constituted by an elastic member and provided with a hermetic pad section which is open on the upper side, in such a manner that it covers the nozzle group 50. An ink absorbing member 72 including a porous material is arranged inside each ink receptacle 66. The ink absorbing member 72 is connected to a pump P by means of a suction tube attached to the ink receptacle 66, and ink that has been absorbed by the ink absorbing member 72 is suctioned and recovered to a recovery vessel 74 (shown in FIG. 5), by driving the pump P. The pump P and the recovery vessel 74 are respectively arranged in each recording head 12 of a different ink color, and therefore the recovered ink of each color can be reused, and unnecessary driving of the pumps can be prevented by halting driving of a pump P not for suctioning ink at present.

Each of the wiping blades 68 is formed by an elastic member of rubber, or the like, and is supported in the raising and lowering device 70 by means of a raising and lowering axle 73. The raising and lowering device 70 is able to raise and lower the wiping blade 68 by moving the raising and lowering axle 73 upwards and downwards, so that the wiping blade 68 can be made to project up to a position where it lies in contact with the lower surface of the recording head 12. If the raising and lowering device 70 is moved in the paper conveyance direction by driving the movement device 71, while the wiping blades 68 are in contact with the lower surface of the recording head 12, then ink droplets or foreign material that has adhered to the nozzles 52 or nozzle face 14 can be wiped away and removed by the front end of the wiping blade 68. Thereby, the ink receptacles 66 also move in the paper conveyance direction, as well as the wiping blades 68.

By means of the suction chamber 40 having a composition of this kind, if the belt 17 is driven over the suction chamber 40 while a negative pressure is applied to the interior of the suction chamber 40 by the suctioning action of the fans 60, then the air can be suctioned inside the suction chamber 40 through the suction holes 56 of the belt 17. Consequently, if the recording paper 16 is positioned on the belt 17 in such a manner that it closes off the suction holes 56, then the recording paper 16 is held onto the belt 17 by suction. Simultaneously with this, the portion of the belt 17 where the suction holes 56 are not formed is drawn toward the suction chamber 40 by suction (the downward direction in FIG. 5), and hence the belt 17 is prevented from lifting up toward the recording head 12, and the clearance between the recording paper 16 and the nozzles 52 can be maintained at a uniform value.

Figure 7:
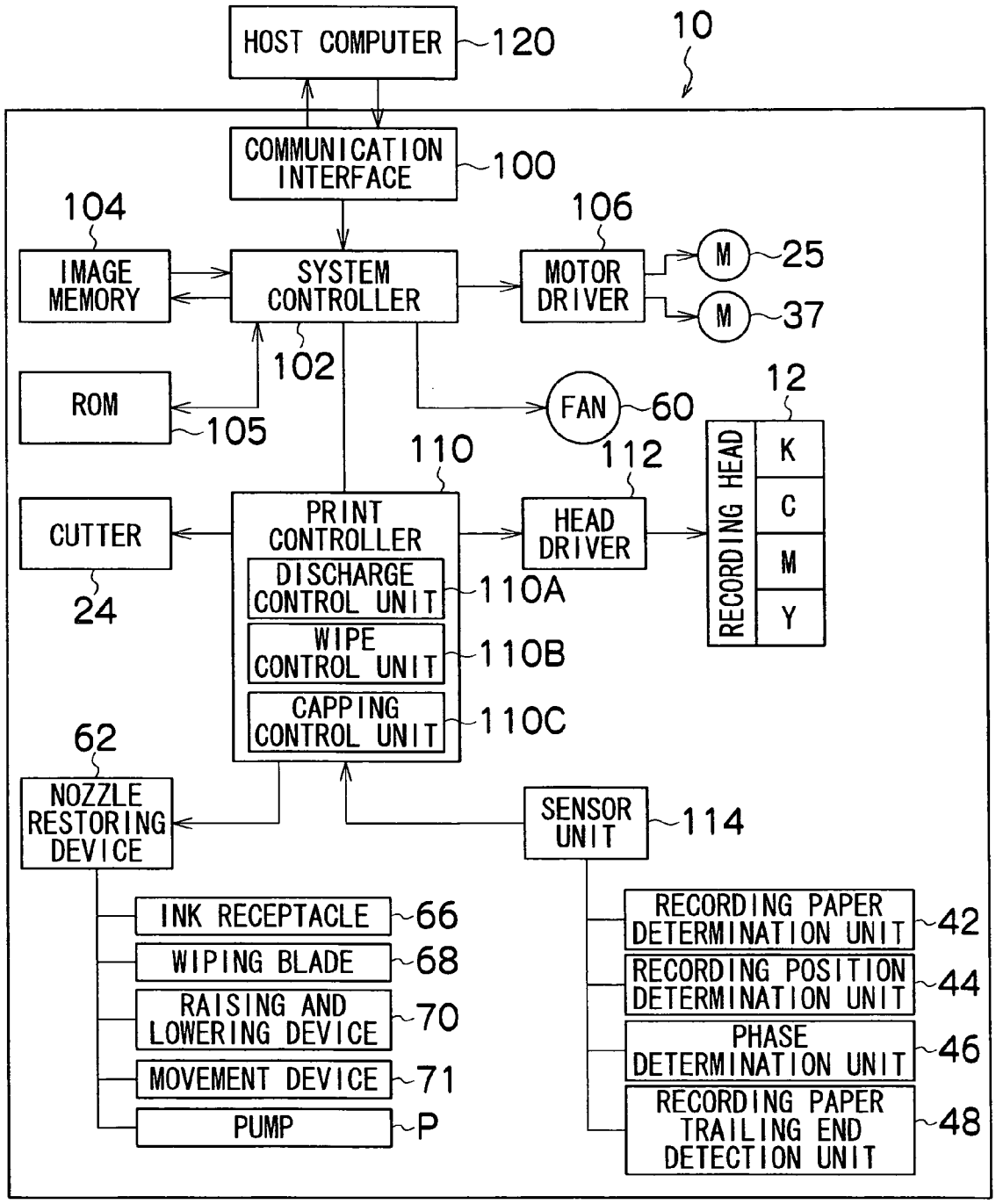
FIG. 7 is a block diagram of principal components showing the system composition of the image forming apparatus.

FIG. 7 is a block diagram of principal components showing the system composition of the image forming apparatus 10. The image forming apparatus 10 comprises a communications interface 100, a system controller 102, a print control unit 110, a head driver 112, a sensor unit 114, the cutter 24, the nozzle restoring devices 62, and the like.

The communications interface 100 is an interface unit for receiving image data transmitted by a host computer 120. For the communications interface 100, a serial interface, such as USB, IEEE 1394, the Internet, or a wireless network, or a parallel interface, such as Centronics, can be used. Image data sent from the host computer 120 is read into the image forming apparatus 10 through the communications interface 100, and it is stored temporarily in an image memory 104. The image memory 104 is a storage device for temporarily storing inputted image data, and reading and writing of the image data is carried out through the system controller 102.

The system controller 102 functions as a control device for controlling the whole inkjet recording apparatus 10 in accordance with a predetermined program, and it also functions as a calculating device for performing various types of calculations. More specifically, the system controller 102 is constituted by a central processing unit (CPU), peripheral circuits relating to same, and the like. The system controller 102 controls respective units, such as the communications interface 100, the image memory 104, the motor driver 106, the fans 60, and the like, and it also controls communications with the host computer 120 and read and write operations to and from the image memory 104, and the like, as well as generating control signals for controlling the conveyance of the recording paper 16 by means of the motors 25 and 37 and the operation of the fans 60 in the suction chamber 40.

Programs executed by the CPU of the system controller 102, various data required for control procedures, and the like, are stored in a ROM 105. The ROM 105 may be a non-rewriteable storage device, or it may be a rewriteable storage device, such as an EEPROM. The image memory 104 is used as a temporary storage region for image data, and it is also used as a program development region and a calculation work region for the CPU.

The motor driver 106 is a driver (drive circuit) which drives the motors 25 and 37 in accordance with instructions from the system controller 102.

The print controller 110 is constituted by an ejection control unit 110A, a wiping control unit 110B and a capping control unit 110C. The ejection control unit 110A is a control section for controlling ejection operations from the recording head 12 (including preliminary ejection operations), and it functions as an "ejection control device". The wiping control section 110B is a control section for controlling the operation of the wiping blades 68 in the nozzle restoring devices 62, and it functions as a "wiping control device". The capping control unit 110C is a control unit for controlling the operation of the ink receptacles 66 (which are equivalent to capping members) in the nozzle restoring devices 62 (namely, the advancing and retreating action of the ink receptacles 66 with respect to the nozzle face), and it functions as a "capping control device".

In other words, the print control unit 110 is a control unit for controlling various sections, such as the head driver 112, the cutter 24, the nozzle restoring devices 62, and the like, on the basis of detection results from the sensor unit 114. In accordance with the control implemented by the system controller 102, the print control unit 110 performs various treatment processes, and the like, in order to generate a recording control signal from the image data in the image memory 104, and it supplies the recording control signal (image formation data) thus generated to the head driver 112.

The head driver 112 drives the recording heads of respective colors (K, C, M, Y) in the recording head 12, on the basis of the image formation data supplied from the print control unit 110.

The sensor unit 114 arranged in the print control unit 110 is a block comprising the aforementioned recording paper determination unit 42, the recording position determination unit 44, the phase determination unit 46, and the recording paper trailing end detection unit 48 (shown in FIG. 1), and the determination results obtained by these various units are supplied to the print control unit 110. The print control unit 110 carries out predetermined calculational processes on the basis of the determination results obtained by the respective determination units, and supplies the results of this processing to the system controller 102. More specifically, the timing of cutting the recording paper 16 by means of the cutter 24, and the like, is determined on the basis of the determination results from the recording paper determination unit 42. Furthermore, the ink ejection timing, and the like, is determined on the basis of the determination results from the recording position determination unit 44, and the positions of the suction holes 56 in the belt 17 are determined, and the position at which the recording paper 16 is placed on the belt 17 is decided, on the basis of the determination results from the phase determination unit 46. Jamming of the recording paper 16 is detected and the supply timing of the next sheet, and the like, is decided, on the basis of the detection results from the recording paper trailing end detection unit 48.

Here, the phase determination unit 46 detects the belt phase determination marks 17A and 17B, which are formed on the side edges of the belt 17, as shown in FIGS. 4A and 4B. The marks 17A are located in positions corresponding to the positions where the suction holes 56 are formed, and hence the positions of the suction holes 56 can be determined by the phase determination unit 46A on the basis of these marks 17A. Furthermore, the mark 17B is formed in one position on the belt, for instance, and allows the phase determination unit 46B to determine the period of one cycle of the belt 17. The positions of the recording paper 16 and the suction holes 56 are determined as they travel by the phase determination unit 46 and the recording paper determination unit 42, and processing for restoring the recording head 12 by means of the nozzle restoring devices 62, as described hereafter, is carried out accordingly.

Next, the action of the image forming apparatus 10 having the foregoing composition will be described.

In FIG. 7, the image data to be printed is inputted from the host computer 120 through the communications interface 100, and it is stored in the image memory 104. The system controller 102 drives the motors 25 and 37 through the motor driver 106, the recording paper 16 is picked up from the roll paper 26 illustrated in FIG. 1 and it is conveyed to the cutter 24. The system controller 102 causes the recording paper 16 to be cut by the cutter 24 to a paper size predetermined according to the image data, through the print control unit 110, and the cut recording paper 16 is transported to the belt conveyance unit 18. Thereupon, the system controller 102 outputs a control signal to the motor driver 106 in order to place the cut recording paper 16 on the belt 17, on the basis of the determination results from the sensor unit 114. More specifically, the position of the recording paper 16 and the position of the suction holes 56 in the belt 17 are respectively determined by the recording paper determination unit 42 and the phase determination unit 46, and the system controller 102 outputs a command signal to the motor driver 106 in such a manner that the suction holes 56 are located in a position that is covered by the recording paper 16, on the basis of these determination results. Upon receiving this command signal, the motor 25 is controlled so as to rotate the rollers 21, and the motor 37 is controlled so as to rotate the rollers 30, 32, 34 and 36.

Moreover, the fans 60 are driven by the system controller 102 and air is suctioned out through the suction holes 56 in the belt 17. Due to the suctioning of the air through the suction holes 56, the recording paper 16 on the belt 17 is tightly held onto the belt 17 by suction during conveyance.

When the recording paper 16 is conveyed on the belt 17 and reaches the recording head 12, an image is formed onto the recording paper 16. More specifically, the image data stored in the image memory 104 in FIG. 7 is supplied to the print control unit 110, and it is converted into data for dots of each ink color, by means of the head driver 112. The head driver 112 reads in this dot data, and generates a drive control signal for the recording head 12. By supplying the drive control signal generated by the head driver 112 to the recording head 12, ink is ejected from the nozzles 52 onto the recording surface of the recording paper 16. The ink ejection timing from the recording head is controlled in synchronism with the conveyance speed of the recording paper 16, on the basis of the determination results from the recording position determination unit 44 of the sensor unit 114, and hence the recording head 12 is able to form an image on the recording paper 16 without halting the conveyance of the recording paper 16. The recording paper 16 on which an image has been recorded is conveyed further by the belt 17 and is outputted from the paper output unit 22.

Next, processing for restoring the recording head 12 by means of the nozzle restoring devices 62 will be described. When printing has been performed continuously, processing for restoring the recording head 12 as described below is carried out at a predetermined time or after a predetermined number of printing operations, in order to remove defective ink from the nozzles that have not been used (ink which has dried or changed viscosity due to lack of use).

If a recording operation has been performed continuously up to a predetermined period of time or a predetermined number of prints, then the print controller 110 determines the leading end of the recording paper 16 that is being conveyed, by means of the recording paper determination unit 42, and determines the position of the suction holes 56 by means of the phase determination unit 46, and when the trailing end of the recording paper 16 currently being conveyed has passed the recording head 12K and the suction holes 56 are positioned facing the recording head 12K, then through the head driver 112, the print controller 110 causes a preliminary ejection of ink to be performed from the nozzles of the recording head 12K (the nozzles facing the position of the suction holes 56). In other words, while the gap between respective sheets of recording paper 16 is located at the position facing the recording head 12K, and when the suction holes 56 are positioned facing the recording head 12K, a preliminary ejection of ink is performed from the nozzles of the recording head 12K, toward the suction holes 56 located between the sheets of recording paper 16. The ink thus ejected is deposited onto the ink receptacles 66 located below the suction holes 56 and is absorbed by the ink absorbing members 72.

After performing a process for restoring ejection errors in the recording head 12K in this manner, a similar process is performed successively while the suction holes 56 located between the paper sheets are moving to positions corresponding to the other recording heads 12 (12C, 12M and 12Y), and ink that does not contribute to printing is ejected toward the suction holes 56 located between the paper sheets. Thereby, a restoration process is carried out for the recording heads of the respective colors. Consequently, since preliminary ejection can be carried out in synchronism with the position of the suction holes 56 located between paper sheets, the recording heads 12 can be restored without interrupting image formation.

Similarly to the restoration processing using the ink receptacles 66 described above, the restoration processing using the wiping blades 68 is also carried out when the suction holes 56 are positioned facing the recording head 12, by utilizing the gap between the trailing end of the recording paper 16 currently being conveyed and the leading end of the recording paper 16 conveyed subsequently. The print controller 110 drives the raising and lowering devices 70, thereby causing the wiping blades 68 to advance and retreat with respect to the recording head 12 by passing through the suction holes 56, while at the same time, it drives the movement device 71 and causes the wiping blades 68 to move at the same speed as the speed of travel of the suction holes 56, thereby causing the front ends of the wiping blades 68 to rub against the nozzle face 14. Thereby, defective ink, and the like, that has adhered to the nozzle face 14 and the periphery of the nozzles 52 can be removed. When cleaning of the nozzles 52 has been completed, the raising and lowering axles 73 of the raising and lowering devices 70 are lowered, and the wiping blades 68 are retracted from the recording head 12. Thereupon, as the suction holes 56 move successively to positions facing the other recording heads 12, the nozzles 52 are cleaned in a similar manner by the respective wiping blades 68 disposed facing the recording heads 12 through the suction holes 56. After cleaning the nozzles 52, each wiping blade 68 is moved in a direction opposite to the paper conveyance direction by the movement device 71, thereby returning it to its original position (initial position). In this way, it is possible to remove defective ink, and the like, that has adhered to the vicinity of the nozzles 52 and the nozzle face 14, by means of the wiping blades 68, in synchronism with the position of the suction holes 56 located between paper sheets, and hence processing for restoring the recording heads 12 can be performed without interrupting image formation.

Suctioning of defective ink in the nozzles 52 is also performed by means of the suction holes 56 in the belt 17, similarly to the preliminary ejection and wiping operations. By driving the raising and lowering devices 70, the ink receptacles 66 (which function here as the suction caps) are caused to advance up to positions where they make contact with the lower face of the recording head 12, and they are fitted hermetically onto the lower face of the recording head 12. In this state, if the air inside the ink receptacles 66 is suctioned by driving the pump P, then the ink (defective ink) inside the nozzles can be suctioned out and removed by means of the ink receptacles 66. In this case, the marks 17A and 17B are detected by the phase determination unit 46, and the driving of the belt 17 is halted in such a manner that the suction holes 56 are positioned facing the ink receptacles 66. The ink that is removed is deposited onto the ink absorbing member 72 and is absorbed by same and then recovered through the suction tube into the recovery vessel 74.

To explain the action for preventing drying of the ink, when the apparatus is not printing, the ink receptacles 66 are always placed in tight contact with the lower face of the recording head 12, by means of the raising and lowering devices 70, and hence the nozzles 52 (nozzle groups 50) of the recording head 12 are covered by the ink receptacles 66. Thereby, the nozzles 52 can be prevented from drying out, and it is thus possible to prevent deterioration of the ink in the nozzles 52, as well as preventing adherence of dirt, or the like, to the nozzles 52.

In this way, by means of the image forming apparatus 10 according to the present embodiment, restoration processing can be performed with respect to all of the nozzles, without removing the recording heads 12. Furthermore, by adopting the suction holes 56 that are disposed in a staggered fashion on the belt 17, it is possible to prevent decline in the rigidity of the belt 17. Moreover, since the devices for performing restoration processing are disposed inside the suction chamber 40 of the belt conveyance unit 18, the image forming apparatus 10 can be made compact in size, and hence the space required to install the image forming apparatus 10 can be reduced.

Here, the composition has been described where the nozzle restoring devices 62 are moved independently in the paper conveyance direction, but it is also possible to adopt a composition where the respective positions of the nozzles 52 and the suction holes 56 in the paper conveyance direction are aligned so as to be mutually facing, and nozzle restoring devices 62 are moved together in the paper conveyance direction. Furthermore, a composition where the nozzle restoring devices 62 are moved has been described, but it is also possible to adopt a composition where a movement device for the belt conveyance unit 18 is arranged and the whole of the belt conveyance unit 18 is moved in the paper conveyance direction, together with the nozzle restoring device 62. In compositions such as these, beneficial effects similar to those of the present invention are obtained.

Moreover, in the image forming apparatus according to the present embodiment, the composition has been described where which restoration processing for the recording heads is carried out when a predetermined period of time or number of recording operations has passed, but the present invention is not limited to this, and it is also possible to adopt a composition where a conventional line sensor for detecting ink ejection errors, for example, is arranged in the vicinity of the recording head 12, and the aforementioned restoration processing for the recording heads is implemented when an ejection error has been detected by the line sensor. In this case, it is not necessary to arrange the nozzle restoring devices 62 respectively at the suction holes 56, but rather a composition may be adopted, for example, where only one nozzle restoring device 62 is arranged inside the suction chamber 40, movably in the paper conveyance direction and in a direction orthogonal to the paper conveyance direction, the nozzle restoring device 62 being moved up to a recording head where an ejection error has been detected and restoration processing being carried out for that recording head only. In particular, if the nozzle restoring device 62 can be moved between a position opposing the recording head 12 and a standby position, then the nozzle restoring device 62 can be withdrawn from the suction holes 56 during normal image formation. Thus, a large opening space can be ensured in the suction holes 56 during image formation, and hence the suction force that holds the recording paper 16 during conveyance can be increased and the stability of the conveyance of the recording paper 16 can be improved. The position to which the nozzle restoring device 62 is withdrawn may be inside or outside the suction chamber 40, but it is preferably a position that enables a large opening space to be ensured in the suction holes 56. Therefore, for instance, a composition may be adopted where a raising and lowering device for the nozzle restoring device 62 is arranged in FIG. 5, and the nozzle restoring device 62 is withdrawn from the suction hole 56 by being lowered.

Next, a second embodiment of the image forming apparatus according to the present invention is described with reference to an image forming apparatus 150 shown in FIG. 8. In the image forming apparatus 150, the compositions of the belt conveyance unit 18 and the nozzle restoring devices 62 in the above-described image forming apparatus 10 have been modified, and members which are the same or similar with those in the image forming apparatus 10 are designated with the same reference numerals and description thereof is omitted.

The image forming apparatus 150 comprises the recording head 12, a belt conveyance unit 154 disposed facing the recording head 12, a nozzle restoring device 156 disposed inside the belt conveyance unit 154, and the like.

The belt conveyance unit 154 has a structure where an electrostatic holding belt 162 is set around rollers 158 and 160. The electrostatic holding belt 162 is able to electrostatically hold the recording paper 16 onto the holding face of the belt, by means of an electrostatic effect. The electrostatic holding belt 162 is provided with an opening section 163 having the same composition as the above-described suction holes 56. A pressure roller 151 causes the recording paper 16 to be held onto the electrostatic holding belt 162. The electrostatic holding belt 162 is driven in the counterclockwise direction in FIG. 1, by means of the drive force of the motor 37 (shown in FIG. 7) being transmitted to the rollers 158 and 160, and the recording paper 16 held on the electrostatic holding belt 162 is conveyed from right to left in FIG. 8.

The nozzle restoring device 156 comprises: the ink receptacle 66 and the wiping blade 68 disposed facing the recording head 12; the raising and lowering device 70, which moves the ink receptacle 66 and the wiping blade 68 so as to advance toward and retract from the recording head 12; and the movement device 71 for causing the raising and lowering device 70 to move following the direction of conveyance of the recording paper 16.

If the raising and lowering device 70 is driven and the wiping blade 68 is made to contact the nozzle face 14 of the recording head 12, and in this state the raising and lowering device 70 is moved in the paper conveyance direction by driving the movement device 71 in synchronism with the opening section 163, then ink droplets or foreign material that have adhered to the nozzles 52 and the lower face of the recording head 12 can be removed by being wiped away by the front end of the wiping blade 68. When the cleaning has been completed, the wiping blade 68 is withdrawn from the recording head 12 by means of the raising and lowering device 70, and the raising and lowering device 70 is moved in the opposite direction to the paper conveyance direction by the movement device 71 and is thereby returned to its initial position.

In the case of preliminary ejection, after the trailing end of the recording paper 16 currently being conveyed has passed the recording head 12 and when the opening section 163 is positioned facing the recording head 12K, the head driver 112 causes ink to be ejected from the nozzles of the recording head 12 facing the position of the opening section 163.

Moreover, similarly to the operations of preliminary ejection and wiping, the suctioning of the nozzles is also carried out through the opening section 163 in the electrostatic holding belt 162. By driving the raising and lowering device 70, the ink receptacle 66 is advanced to a position where it makes contact with the lower face of the recording head 12 and the ink receptacle 66 becomes fitted tightly onto the lower face of the recording head 12. In this state, the pump is driven and defective ink inside the nozzles 52 can be removed by suctioning.

In this way, according to the image forming apparatus 150 of the present embodiment, restoration processing is carried out without interrupting image formation and hence productivity can be improved. Furthermore, since the electrostatic holding belt 162 is used, then the suction chamber 40 described in the foregoing embodiment can be omitted.

Figure 8:
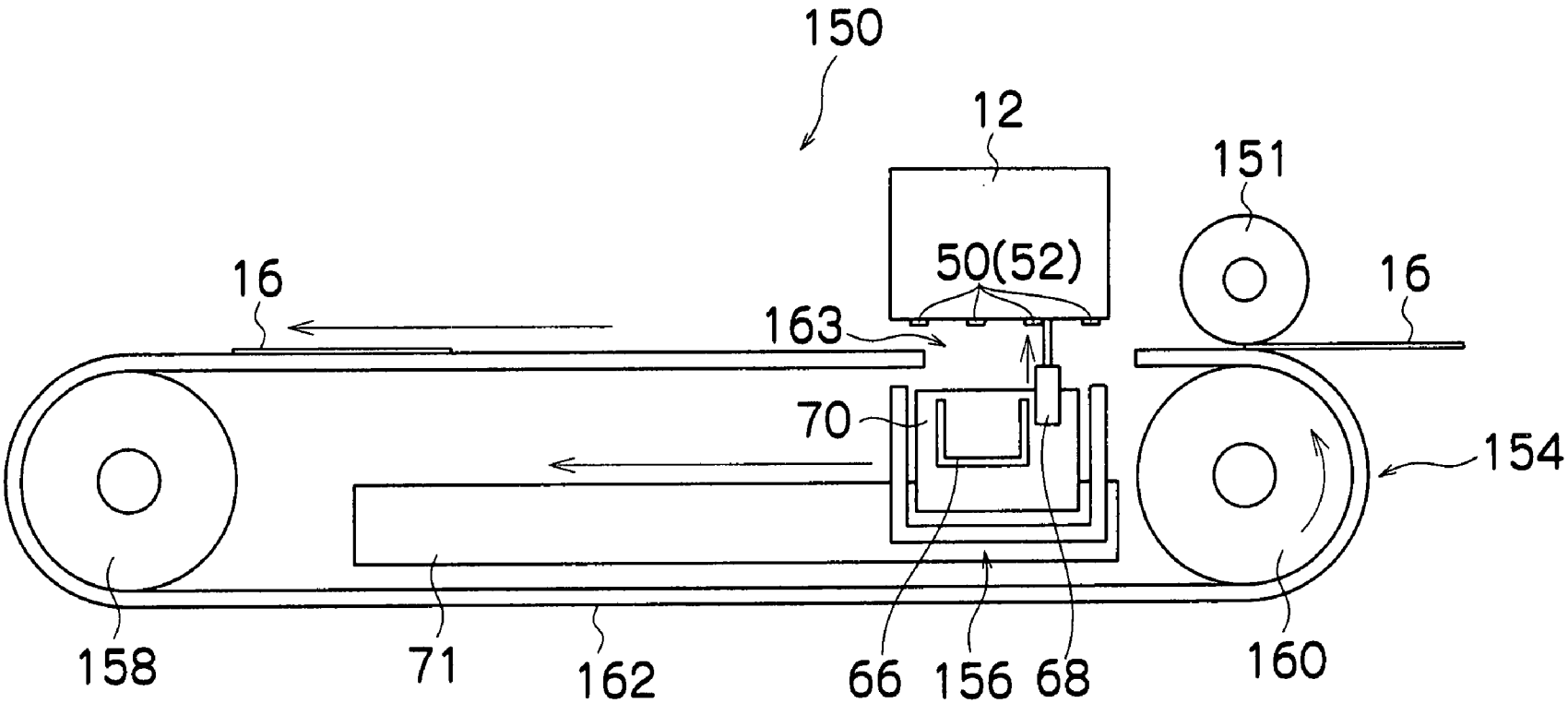
FIG. 8 is a cross-sectional view showing the detailed structure of another example of the nozzle restoring device.

Although only one recording head 12 unit is shown in FIG. 8, it is also possible to install a plurality of recording heads 12 for respective ink colors, these heads being arranged in the paper conveyance direction. Furthermore, a plurality of image forming apparatuses 150 each provided with a recording head for a respective ink color may be arranged in series, and a color image, or the like, may be formed on recording paper 16 by conveying the recording paper 16 in the series direction through the respective image forming apparatuses 150.

Moreover, in the image forming apparatuses 10 and 150 described above, a composition is adopted where the recording paper 16 is conveyed by means of the belt, but the present invention is not limited to this and it is also possible to use a rotating drum that is capable of conveying the recording paper 16 on the outer circumferential face thereof and that has opening sections formed on this outer circumferential face. In this case, a nozzle restoring device is installed inside the rotating drum, and processing for restoring the recording head is carried out by the nozzle restoring device, through the opening sections formed in the outer circumferential section of the rotating drum.

The composition of the image forming apparatus according to the present invention is not limited to that described in the embodiments. For example, the wiping blades 68 are formed by elastic members made of rubber, or the like, but the invention is not limited to this and brushes, or the like, may be used. Furthermore, it is also possible to use a porous member made of a sponge, or the like, as a wiping blade, in such a manner that ink droplets or foreign material are wiped up and recovered.

Moreover, in FIGS. 2 and 3, the nozzle groups 50 of the recording head 12 are disposed in a staggered matrix arrangement; however, even in the case of a line head in which the nozzles are arranged in one row, it is still possible to perform preliminary ejection in synchronism with the position of the suction holes 56, by determining the marks 17A by means of the phase determination unit 46A.

Furthermore, if a composition is adopted where preliminary ejection is performed from the nozzles 52 after cleaning by the wiping blades 68 has completed, then it is possible to eliminate blocking of the nozzles 52 caused by cleaning of the wiping blades 68.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a line type recording head in which a plurality of nozzles ejecting ink are arranged through a length corresponding to a full width of a recording medium;

a recording medium conveyance device which supports and conveys the recording medium in a direction of conveyance of the recording medium and causes the recording head and the recording medium to move relatively to each other, the recording medium conveyance device including a medium supporting part which supports the recording medium, a plurality of opening sections being formed in the medium supporting part, the plurality of opening sections being arranged in a staggered matrix in such a manner that at least one of the plurality of opening sections is present throughout a whole width of a nozzle region of the recording head when the plurality of opening sections are projected so as to be aligned in a direction substantially orthogonal to the direction of conveyance of the recording medium;

an ejection control device which performs control of preliminary ejection of the ink from the recording head toward the opening sections in synchronism with positions of the opening sections; and an ink receiving member which receives the ink in the preliminarily ejection through the opening sections, wherein the ink receiving member moves relative to the recording medium conveyance device and the recording head.

2. The image forming apparatus as defined in claim 1, further comprising:

a phase determining device which performs determination of the positions of the opening sections, wherein the ejection control device performs the control according to a result of the determination obtained by the phase determining device.

3. The image forming apparatus as defined in claim 1, wherein at least two of the plurality of opening sections are formed along the direction of conveyance of the recording medium in the medium supporting part.

4. The image forming apparatus as defined in claim 1, further comprising a negative pressure generating device to create negative pressure by which the medium supporting part holds the recording medium.

5. The image forming apparatus as defined in claim 1, wherein the medium supporting part holds the recording medium on a surface thereof by means of static electricity.

6. The image forming apparatus as defined in claim 1, wherein the medium supporting part includes a drum which rotates while supporting the recording medium.

7. The image forming apparatus as defined in claim 1, further comprising an ink receiving member movement device which moves the ink receiving member between a standby position and a position facing a nozzle face of the recording head.

8. The image forming apparatus of claim 1, wherein the plurality of openings formed in the medium supporting part extend in the direction orthogonal to the direction of conveyance of the recording medium.

9. An image forming apparatus, comprising:

a line type recording head in which a plurality of nozzles ejecting ink are arranged through a length corresponding to a full width of a recording medium;

a recording medium conveyance device which supports and conveys the recording medium in a direction of conveyance of the recording medium and causes the recording head and the recording medium to move relatively to each other, the recording medium conveyance device including a medium supporting part which supports the recording medium, a plurality of opening sections being formed in the medium supporting part, the plurality of opening sections being arranged in a staggered matrix in such a manner that at least one of the plurality of opening sections is present throughout a whole width of a nozzle region of the recording head when the plurality of opening sections are projected so as to be aligned in a direction substantially orthogonal to the direction of conveyance of the recording medium;

a wiping member which wipes a nozzle face of the recording head through the opening sections;

a wiping member advancing and retracting device which causes the wiping member to advance and retract with respect to the nozzle face through the opening sections;

a wiping member sliding device which causes the wiping member to slide with respect to the nozzle face; and a wipe control device which performs control of a wiping action of the wiping member in synchronism with positions of the opening sections.

10. The image forming apparatus as defined in claim 9, further comprising:

a phase determining device which performs determination of the positions of the opening sections, wherein the wipe control device performs the control according to a result of the determination obtained by the phase determining device.

11. The image forming apparatus as defined in claim 9, wherein at least two of the plurality of opening sections are formed along the direction of conveyance of the recording medium in the medium supporting part.

12. The image forming apparatus as defined in claim 9, further comprising a negative pressure generating device to create negative pressure by which the medium supporting part holds the recording medium.

13. The image forming apparatus as defined in claim 9, wherein the medium supporting part holds the recording medium on a surface thereof by means of static electricity.

14. The image forming apparatus as defined in claim 9, wherein the medium supporting part includes a drum which rotates while supporting the recording medium.

15. The image forming apparatus as defined in claim 9, further comprising a wiping member movement device which moves the wiping member between a standby position and a position facing the nozzle face of the recording head.

16. An image forming apparatus, comprising:

a line type recording head in which a plurality of nozzles ejecting ink are arranged through a length corresponding to a full width of a recording medium;

a recording medium conveyance device which supports and conveys the recording medium in a direction of conveyance of the recording medium and causes the recording head and the recording medium to move relatively to each other, the recording medium conveyance device including a medium supporting part which supports the recording medium, a plurality of opening sections being formed in the medium supporting part, the plurality of opening sections being arranged in a staggered matrix in such a manner that at least one of the plurality of opening sections is present throughout a whole width of a nozzle region of the recording head when the plurality of opening sections are projected so as to be aligned in a direction substantially orthogonal to the direction of conveyance of the recording medium;

a capping member which covers the nozzles by making contact with a nozzle face of the recording head through the opening sections;

a capping member advancing and retracting device which causes the capping member to advance and retract with respect to the nozzle face through the opening sections; and a capping control device which performs control of the opening sections to halt in positions facing the capping member, and control of the capping member advancing and retracting device to advance and retract the capping member with respect to the nozzle face through the opening sections.

17. The image forming apparatus as defined in claim 16, further comprising:

a phase determining device which performs determination of the positions of the opening sections, wherein the capping control device performs the control according to a result of the determination obtained by the phase determining device.

18. The image forming apparatus as defined in claim 16, wherein at least two of the plurality of opening sections are formed along the direction of conveyance of the recording medium in the medium supporting part.

19. The image forming apparatus as defined in claim 16, further comprising a negative pressure generating device to create negative pressure by which the medium supporting part holds the recording medium.

20. The image forming apparatus as defined in claim 16, wherein the medium supporting part holds the recording medium on a surface thereof by means of static electricity.

21. The image forming apparatus as defined in claim 16, wherein the medium supporting part includes a drum which rotates while supporting the recording medium.

22. The image forming apparatus as defined in claim 16, further comprising a capping member movement device which moves the capping member between a standby position and a position facing the nozzle face of the recording head.

23. The image forming apparatus as defined in claim 16, further comprising a suction device which is connected to the capping member to suck the ink from the nozzles.

* * * * *